US007475609B2

(12) United States Patent
Liaw

(10) Patent No.: US 7,475,609 B2
(45) Date of Patent: Jan. 13, 2009

(54) POWER RATCHET WRENCH

(75) Inventor: Jian-Shiou Liaw, Taichung Hsien (TW)

(73) Assignee: Rea Lee Industrial Co., Ltd., Dali (TW)

( * ) Notice: Subject to any disclaimer, the term of this patent is extended or adjusted under 35 U.S.C. 154(b) by 164 days.

(21) Appl. No.: 11/705,486

(22) Filed: Feb. 12, 2007

(65) Prior Publication Data

US 2008/0190247 A1 Aug. 14, 2008

(51) Int. Cl.
*B25B 13/46* (2006.01)

(52) U.S. Cl. ..... 74/116; 81/57.39

(58) Field of Classification Search ..... 74/116, 74/111, 118; 81/57.39, 57.29, 57.13, 57.11
See application file for complete search history.

(56) References Cited

U.S. PATENT DOCUMENTS 4,411,173 A * 10/1983 Mixer ..... 60/695
5,237,885 A * 8/1993 Putney et al. ..... 74/116
2005/0076745 A1* 4/2005 Chen ..... 81/57.39
2005/0211026 A1* 9/2005 Cheng ..... 81/57.39

* cited by examiner

*Primary Examiner*—Richard W Ridley
*Assistant Examiner*—Thomas Diaz
(74) *Attorney, Agent, or Firm*—Alan Kamrath; Kamrath & Associates PA

(57) ABSTRACT

The power ratchet wrench has a body, a planet gear device and a mounting bracket. The body has an outer thread and an annular flange. The planet gear device is connected to the body and has three transmitting gear wheels, a rotating bracket, a bearing and a mounting cover. The transmitting gear wheels are mounted in the chamber of the body. The rotating bracket is rotatably mounted in the chamber of the body, is connected with the transmitting gear wheels and has a bottom plate, three mounting posts and an extending rod. The mounting cover is connected to the body around the rotating bracket and has an inner thread and a resisting flange. The mounting bracket is connected to the planet gear device and the body and receives an operating device.

2 Claims, 5 Drawing Sheets

POWER RATCHET WRENCH

BACKGROUND OF THE INVENTION

1. Field of the Invention

The present invention relates to a power ratchet wrench, and more particularly to a power ratchet wrench having an enhanced structure.

2. Description of Related Art

With reference to FIG. 5, a conventional power ratchet wrench has a body (60), a planet gear device (50) and a mounting bracket (40).

The body (60) comprises an open end, a chamber, an inner surface, an inner thread and a drive device. The chamber is defined in the open end of the body (60). The inner thread is formed on the inner surface of the body (60). The drive device is mounted inside the body (60) and has a drive gear wheel. The drive gear wheel is rotatably mounted in the chamber of the body (60).

The planet gear device (50) is connected to the body (60) and has a connecting tube, three transmitting gear wheels and a rotating bracket. The connecting tube is securely connected to the open end of the body (60) and has an inner surface, an outer surface, an outer thread and multiple inner gear teeth. The outer thread is formed on the outer surface of the connecting tube and is screwed securely with the inner thread of the body (60). The inner gear teeth are formed in the inner surface of the connecting tube. The transmitting gear wheels are mounted in the connecting tube and are engaged with the drive gear wheel on the body (60) and the inner gear teeth of the connecting tube. When the drive gear wheel is rotated, the transmitting gear wheels are rotated with the drive gear wheel relative to the inner gear teeth of the connecting tube. Each transmitting gear wheel has a center and a mounting hole. The mounting hole is formed through the center of the transmitting gear wheel. The rotating bracket is rotatably mounted in the connecting tube, is connected with the transmitting gear wheels and has a center, a bottom, a gear wheel hole and three mounting posts. The gear wheel hole is formed through the center of the rotating bracket and corresponds to the drive gear wheel of the body (60). The mounting posts protrude from the bottom of the rotating bracket around the gear wheel hole and are respectively mounted in the mounting holes of the transmitting gear wheels. Accordingly, the rotating bracket is rotated by the rotation of the transmitting gear wheels.

The mounting bracket (40) is securely connected to the planet gear device (50) and the body (60) and has a proximal end, a distal end, a connecting segment (400), an upper clamping segment (401), a lower clamping segment (402), a mounting recess (403) and an operating device (41).

The connecting segment (400) is defined in the proximal end of the mounting bracket (40), is connected to the connecting tube of the planet gear device (50) with a C-ring and a screwed nut and has a center and a crank hole. The crank hole is formed through the center of the connecting segment (400) and communicates with the gear wheel hole of the rotating bracket. The clamping segments (401, 402) are respectively formed on the distal end of the mounting bracket (40) and are parallel to each other to form the mounting recess (403). Each clamping segment (401, 402) has a through hole (404, 405). The through holes (404, 405) are respectively formed through the corresponding clamping segments (401, 402) and communicate with the mounting recess (403).

The operating device (41) is mounted in the mounting bracket (40) and has a rotating crank (410), a drive ring (411) and a unidirectional operating shaft (416). The rotating crank (410) is rotatably mounted in the connecting segment (400), is connected to the rotating bracket of the planet gear device (50) and has an inner end, an outer end, an extending rod and a pushing block. The inner end of the rotating crank (410) extends through the crank hole of the connecting segment (400) and is engaged with the gear wheel hole of the rotating bracket of the planet gear device (50). The extending rod is formed axially and eccentrically on the outer end of the rotating crank (410). The pushing block is mounted around the extending rod. The drive ring (411) is mounted rotatably in the mounting recess (403) between the clamping segments (401, 402) and communicated with the through holes (404, 405), contacts the pushing block and has a curved end, an internal surface and multiple ratchet teeth. The curved end of the drive ring (411) contacts the pushing block. The ratchet teeth are formed on the internal surface. The operating shaft (416) is mounted in the through holes (404, 405) of the clamping segments (401, 402), is engaged with the ratchet teeth of the drive ring (411) and has an external surface, a bottom, multiple pawl teeth and a operating post. The pawl teeth are formed on the external surface of the operating shaft (416) and are engaged with the ratchet teeth of the drive ring (411). The operating post is formed axially on the bottom of the operating shaft (416) and is used to fasten or loosen a bolt or a nut. When the rotating crank (410) is rotated by the rotating bracket, the pushing block will push the drive ring (411) to swing to make the operating shaft (416) rotate. Then, a user can use the operating post to fasten or loosen a bolt or a nut.

However, the drive ring (411) and the operating shaft (416) are mounted in the mounting recess (403) by the clamping segments (401, 402). Consequently, all the force applied to turn the nut or the bolt is transmitted to the clamping segments (401, 402) and causes the clamping segments (401, 402) to be damaged quickly. Then, the drive ring (411) and the operating shaft (416) cannot mount securely in the mounting recess (403) to fasten or loosen a bolt or a nut.

The power ratchet wrench in accordance with the present invention mitigates or obviates the aforementioned problems.

SUMMARY OF THE INVENTION

The main objective of the present invention is to provide a power ratchet wrench that can provide an enhanced structure.

The power ratchet wrench in accordance with the present invention has a body, a planet gear device and a mounting bracket. The body comprises an outer thread and an annular flange. The planet gear device is connected to the body and has three transmitting gear wheels, a rotating bracket, a bearing and a mounting cover. The transmitting gear wheels are mounted in the chamber of the body. The rotating bracket is rotatably mounted in the chamber of the body, is connected with the transmitting gear wheels and has a bottom plate, three mounting posts and an extending rod. The mounting cover is connected to the body around the rotating bracket and has an inner thread and a resisting flange. The mounting bracket is connected to the planet gear device and the body and receives an operating device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
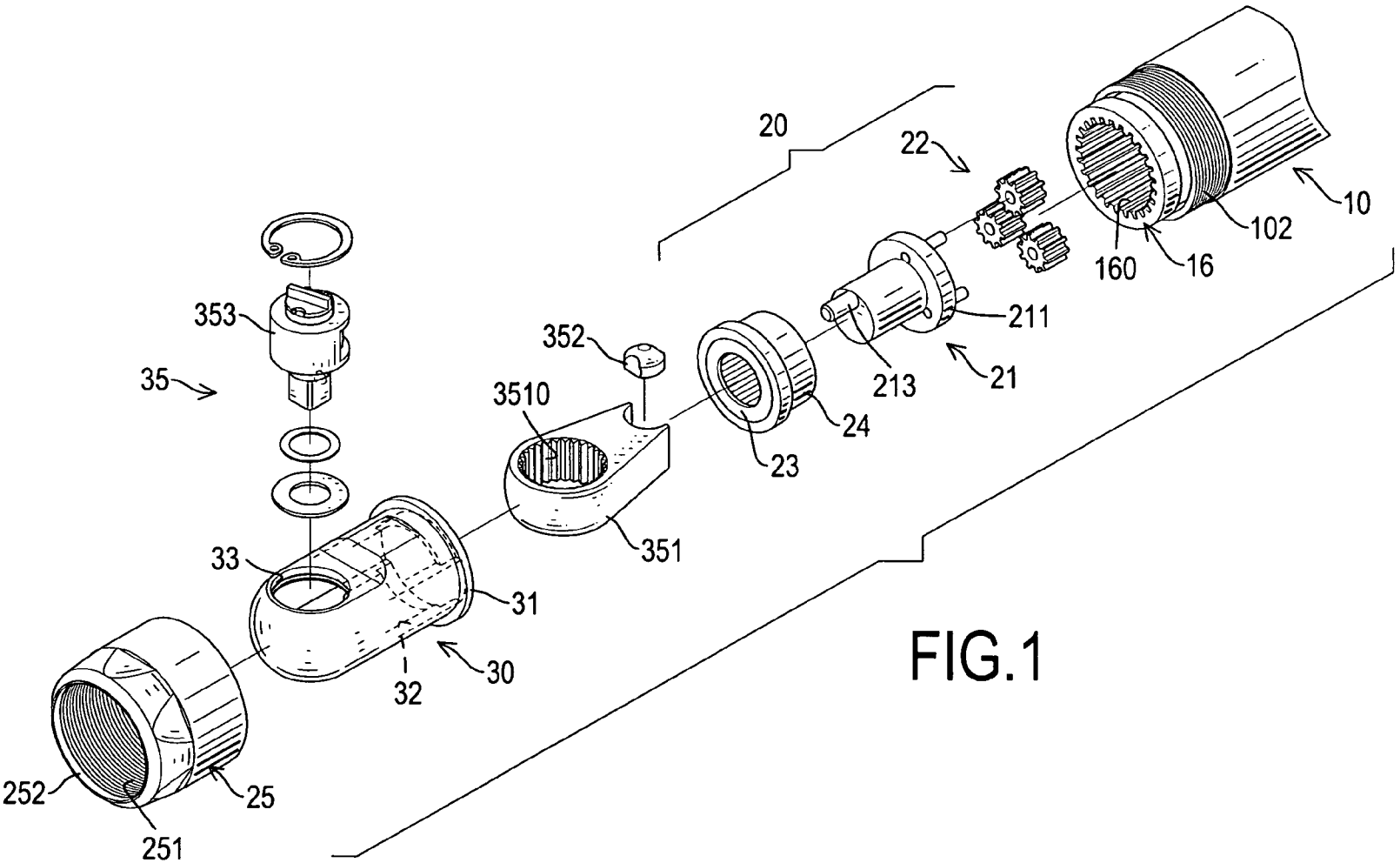
FIG. 1 is an exploded perspective view of a power ratchet wrench in accordance with the present invention.
Figure 2:
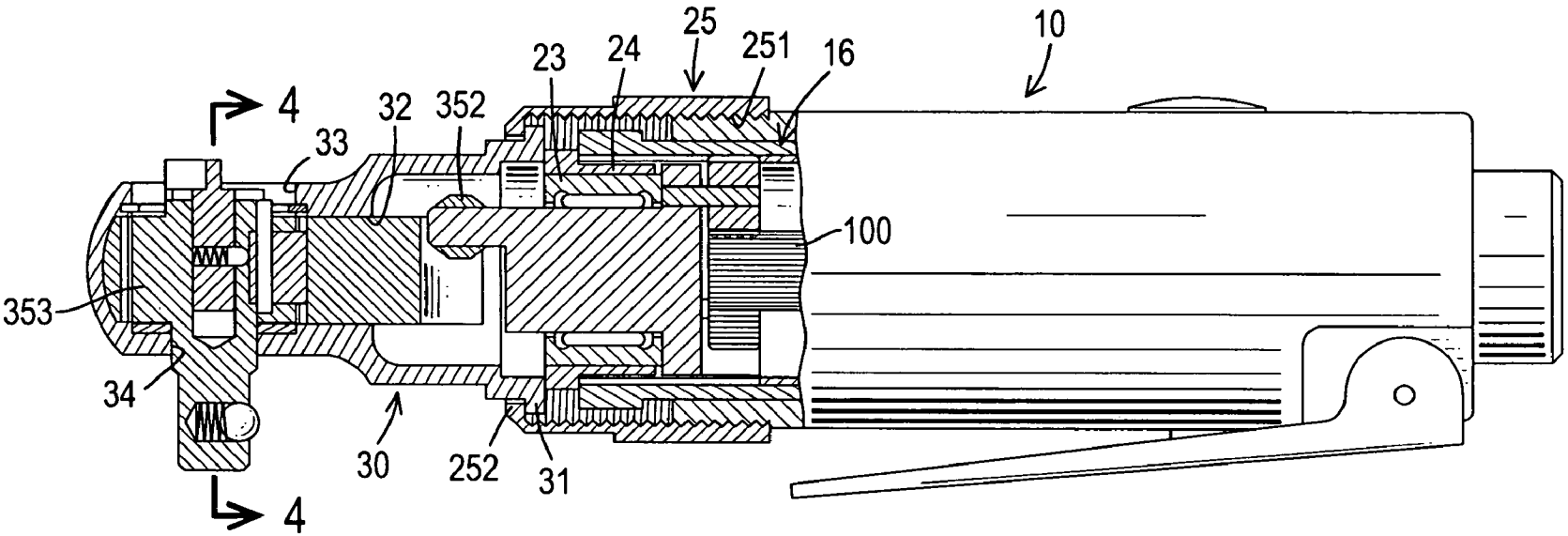
FIG. 2 is a cross sectional side view in partial section of the power ratchet wrench in FIG. 1.
Figure 3:
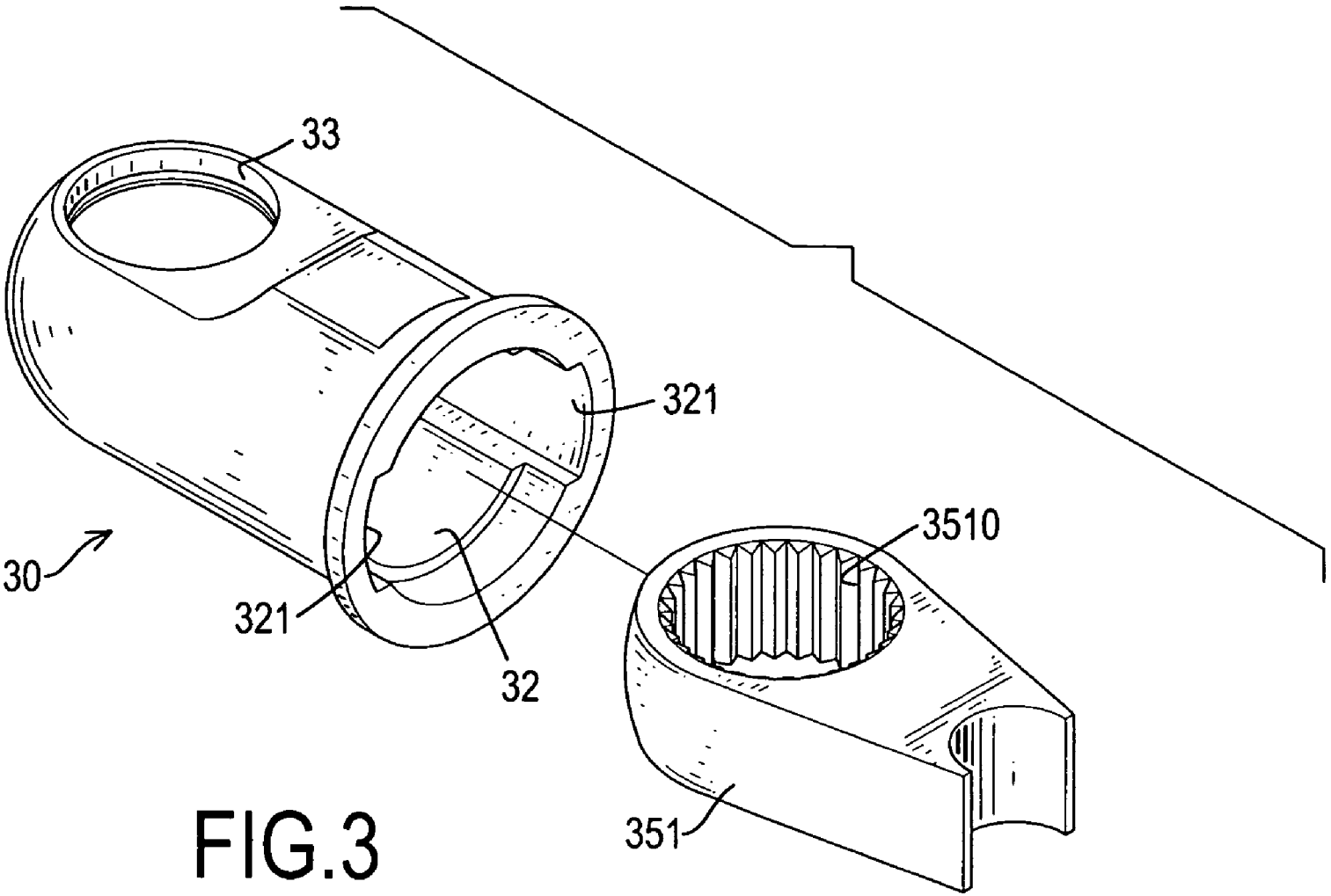
FIG. 3 is an enlarged perspective view of the power ratchet wrench in FIG. 1.

With reference to FIGS. 1, 2 and 3, a power ratchet wrench in accordance with the present invention comprises a body (10), a planet gear device (20) and a mounting bracket (30).

The body (10) comprises an open end, a closed end, a chamber, an outer surface, an outer thread (102), an annular flange (16) and a drive device. The chamber is defined in the open end of the body (10). The outer thread (102) is formed on the outer surface of the body (10) near the open end. The annular flange (16) is formed on the open end of the body (10) and has an inner surface and multiple inner gear teeth (160). The inner gear teeth (160) are formed on the inner surface of the annular flange (16). The drive device is mounted inside the body (10) and has a drive shaft (100). If the power source of the wrench is compressed air, the drive device further comprises a vane wheel. If the wrench is electric powered, the drive device has a motor. The drive shaft is connected to and driven by the vane wheel or the motor and rotatably extends into the chamber of the body (10).

The planet gear device (20) is connected to the body (10) and has three transmitting gear wheels (22), a rotating bracket (21), a bearing sheath (24), a bearing (23) and a mounting cover (25). The transmitting gear wheels (22) are mounted in the chamber of the body (10) and are engaged rotatably with the drive shaft (100) of the body (10) and the inner gear teeth (160) of the annular flange (16). When the drive shaft (100) is rotated, the transmitting gear wheels (22) are rotated with the drive shaft (100) relative to the inner gear teeth (160) of the annular flange (16). Each transmitting gear wheel (22) has a center and a mounting hole. The mounting hole is formed through the center of the transmitting gear wheel (22). The rotating bracket (21) is rotatably mounted in the chamber of the body (10), is connected with the transmitting gear wheels (22) and has a top, a bottom, a bottom plate (211), three mounting posts and an extending rod (213). The bottom plate (211) is formed on the bottom of the rotating bracket (21) and faces the transmitting gear wheels (22). The mounting posts protrude from the bottom of the rotating bracket (21) and are respectively mounted in the mounting holes of the transmitting gear wheels (22), such that the rotating bracket (21) can be rotated by the rotation of the transmitting gear wheels (22). The extending rod (213) is formed axially and eccentrically on the top of the rotating bracket (21). The bearing sheath (24) is mounted around the rotating bracket (21) and contacts the annular flange (16) of the body (10). The bearing (23) is mounted in the bearing sheath (24) and contacts the bottom plate (211) on the rotating bracket (21). The mounting cover (25) is connected securely to the body (10) around the rotating bracket (21), the bearing sheath (24) and the bearing (23) and has a front end, an inner surface, an inner thread (251) and a resisting flange (252). The inner thread (251) is formed on the inner surface of the mounting cover (25) and is screwed securely with the outer thread (102) to cover the rotating bracket (21) and the bearing sheath (24) inside the body (10). The resisting flange (252) is formed on the front end of the mounting cover (25).

The mounting bracket (30) is securely connected to the planet gear device (20) and the body (10) and receives an operating device (35). The mounting bracket (30) has an open end, a closed end, a top face, a bottom face, a mounting flange (31), a mounting recess (32), an upper through hole (33) and a lower through hole (34). The mounting flange (31) is formed around the open end of the mounting bracket (30) and abuts with the resisting flange (252) of the mounting cover (25). The mounting recess (32) is defined in the mounting bracket (30), extends towards the open end of the mounting bracket (30) and has two inserting channels (321). The inserting channels (321) are formed inside the mounting bracket (30) from the open end to the closed end, face each other and communicate with the mounting recess (32).

The through holes (33, 34) are respectively formed through the top face and the bottom face and communicate with the mounting recess (32). The operating device (35) is mounted in the mounting recess (32) of the mounting bracket (30) and has a pushing block (352), a drive ring (351) and a unidirectional operating shaft (353). The pushing block (352) is mounted around the extending rod (213) of the rotating bracket (21). The drive ring (351) is mounted in the mounting recess (32) of the mounting bracket (30) between the inserting channels (321), aligns with the through holes (33, 34), contacts the pushing block (352) and has a curved end, an internal surface and multiple ratchet teeth (3510). The curved end of the drive ring (351) contacts the pushing block (352). The ratchet teeth (3510) are formed on and protrude inwardly from the internal surface of the drive ring (351). The operating shaft (353) is mounted in the through holes (33, 34) of the mounting bracket (30), is engaged with the ratchet teeth (3510) of the drive ring (351) and has an external surface, a bottom, multiple pawl teeth and an operating post. The pawl teeth are formed on the external surface of the operating shaft (353) and are engaged with the ratchet teeth (3510) of the drive ring (351). The operating post is formed axially on the bottom of the operating shaft (353) and is used to fasten or loosen a bolt or a nut. When the extending rod (213) is rotated by the rotating bracket (21), the pushing block (352) will push the drive ring (351) to swing to make the operating shaft (353) rotate. Then, a user can use the operating post to fasten or loosen a bolt or a nut.

Figure 4:
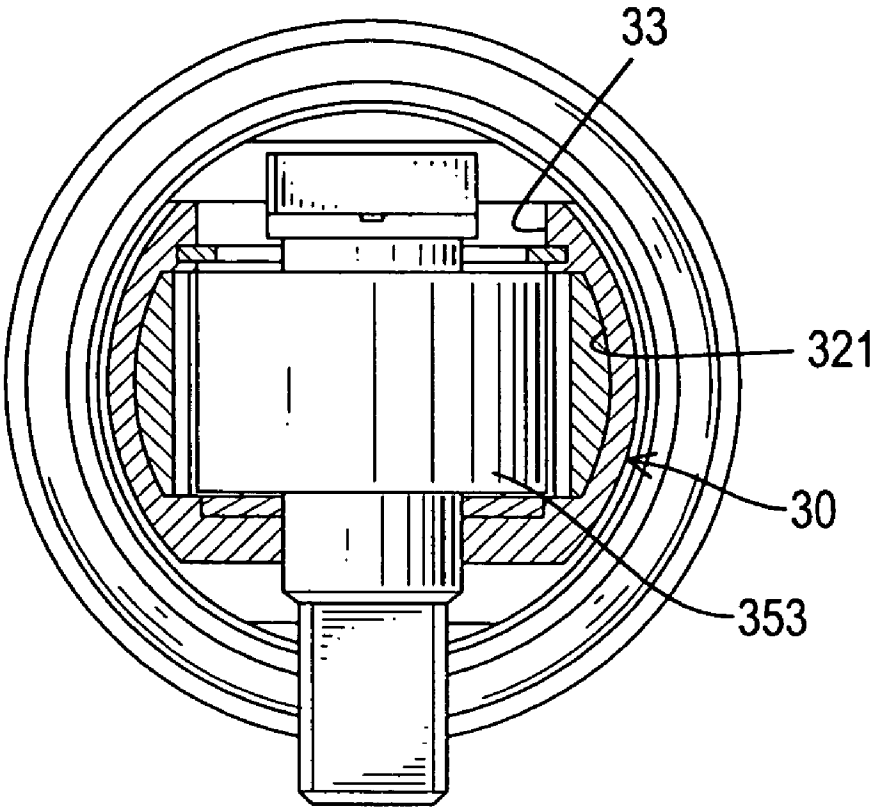
FIG. 4 is a side view of the power ratchet wrench along the line 4-4 in FIG. 2.
Figure 5:
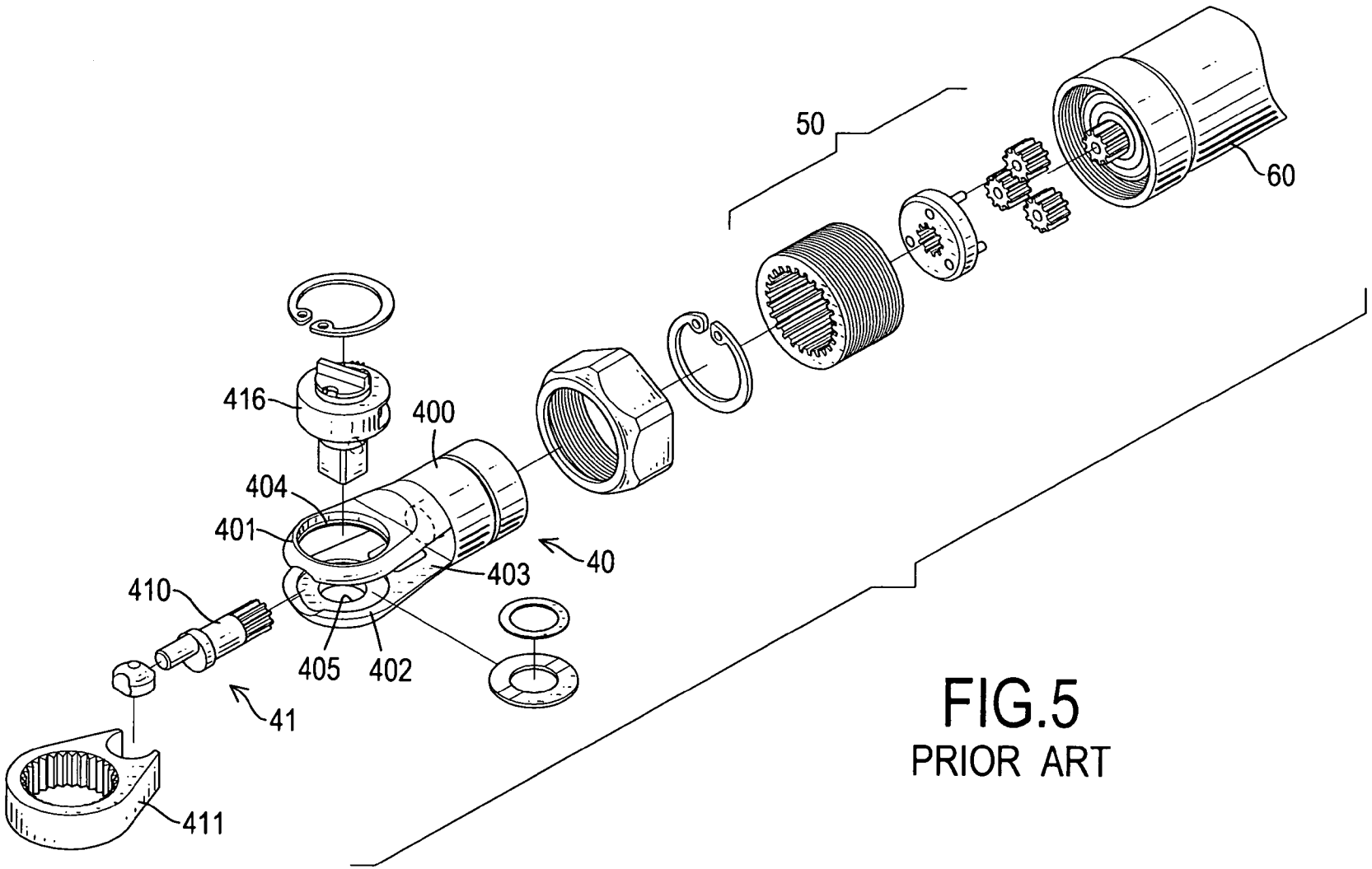
FIG.5 PRIOR ART
FIG. 5 is an exploded perspective view of a conventional power ratchet wrench in accordance with the prior art.

With reference to FIGS. 3 and 4, the drive ring (351) and the operating shaft (353) are mounted securely in the mounting recess (32) of the mounting bracket (30) by the inserting channels (321). Consequently, because the mounting bracket (30) has a closed end, all the force applied to turn the nut or the bolt is transmitted uniformly to the mounting bracket (30) and the structural strength of the mounting bracket (30) is enhanced. Therefore, the mounting bracket (30) can be prevented from being damaged due to the vibration and loading generated by the operation of the drive ring (351) and the operating shaft (353).

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A power ratchet wrench comprising a body having an open end;

a closed end;

a chamber defined in the open end of the body;
an outer surface;
an outer thread formed on the outer surface of the body near the open end; and
an annular flange formed on the open end of the body and having
an inner surface; and
multiple inner gear teeth formed on the inner surface of the annular flange;

a planet gear device connected to the body and having
three transmitting gear wheels mounted in the chamber of the body and engaged rotatably with the inner gear teeth of the annular flange, and each transmitting gear wheel having
a center; and
a mounting hole formed through the center of the transmitting gear wheel;
a rotating bracket rotatably mounted in the chamber of the body, connected with the transmitting gear wheels and having
a top;
a bottom;
a bottom plate formed on the bottom of the rotating bracket and facing to the transmitting gear wheels;
three mounting posts protruding from the bottom of the rotating bracket and respectively mounted in the mounting holes of the transmitting gear wheels; and
an extending rod formed axially and eccentrically on the top of the rotating bracket;
a bearing mounted around the rotating bracket and contacting with the bottom plate; and
a mounting cover connected securely to the body around the rotating bracket and the bearing and having
a front end;
an inner surface;
an inner thread formed on the inner surface of the mounting cover and screwed securely with the outer thread to cover the rotating bracket inside the body; and
a resisting flange formed on the front end of the mounting cover; and a mounting bracket securely connected to the planet gear device and the body and having
an open end,
a closed end;
a top face;
a bottom face;
a mounting flange formed around the open end of the mounting bracket and contacting the resisting flange of the mounting cover;
a mounting recess in the mounting bracket, extending towards the open end of the mounting bracket and having two channels formed inside the mounting bracket from the open end to the closed end and facing each other;
an upper through hole formed through the top face and communicating with the mounting recess; and
a lower through hole formed through the bottom face and communicating with the mounting recess; and an operating device mounted in the mounting recess of the mounting bracket and having
a pushing block mounted around the extending rod of the rotating bracket;
a drive ring mounted in the mounting recess of the mounting bracket between the two channels and aligned with the through holes, with the drive ring contacting the pushing block and having
a curved end contacting the pushing block;
an internal surface; and
multiple ratchet teeth formed on and protruding inward from the internal surface of the drive ring; and
a unidirectional operating shaft mounted in the through holes of the mounting bracket, engaged with the ratchet teeth of the drive ring and having
an external surface;
a bottom;
multiple pawl teeth formed on the external surface of the operating shaft and engaged with the ratchet teeth of the drive ring; and
an operating post formed axially on the bottom of the operating shaft.

2. The power ratchet wrench as claimed in claim 1, wherein the plant gear device has a bearing sheath mounted around the rotating bracket, the bearing sheath contacts the annular flange of the body, and the bearing is mounted in the bearing sheath.

* * * * *